United States Patent [19]

Chesebro, Jr. et al.

[11] 4,397,161

[45] Aug. 9, 1983

[54] SOCK WITH A COMPRESSIVE SUPPORT FOOT

[75] Inventors: Robert E. Chesebro, Jr., Sheboygan; Richard H. Heinig, Sheboygan Falls, both of Wis.

[73] Assignee: Wigwam Mills, Inc., Sheboygan, Wis.

[21] Appl. No.: 299,478

[22] Filed: Sep. 4, 1981

[51] Int. Cl.[3] ..... D04B 9/46

[52] U.S. Cl. ..... 66/178 A; 2/239; 66/172 E

[58] Field of Search ..... 2/239, 240; 66/178 A, 66/178 R, 172 E; 128/165

[56] References Cited

U.S. PATENT DOCUMENTS

| | | | |
|---|---|---|---|
| 2,384,392 | 9/1945 | Page | 66/172 E |
| 3,217,336 | 11/1965 | Wikler | 2/239 |
| 3,729,956 | 5/1973 | Nebel et al. | 66/172 E |
| 4,027,667 | 6/1977 | Swallow et al. | 2/240 X |
| 4,172,456 | 10/1979 | Zens | 66/178 A |
| 4,180,065 | 12/1979 | Bowen | 66/172 E X |

*Primary Examiner*—H. Hampton Hunter

*Attorney, Agent, or Firm*—Bell, Seltzer, Park & Gibson

[57] ABSTRACT

Elastomeric yarn is incorporated in regularly repeated certain courses throughout the leg and foot portion of the sock. The certain courses in which the elastomeric yarn is incorporated in the foot portion are closer together than the certain courses in which the elastomeric yarn is incorporated in the leg portion so that the density of elastomeric yarn is greater in the foot portion than the density of the elastomeric yarn in the leg portion. The greater density of elastomeric yarn in the foot portion provides a snug fit, provides greater compressive support in the foot portion than in the leg portion, and aids in the stimulation of blood flow from the foot and up the leg of the wearer.

6 Claims, 3 Drawing Figures

SOCK WITH A COMPRESSIVE SUPPORT FOOT

FIELD OF THE INVENTION

This invention relates generally to a hosiery article, such as a sock, with elastomeric yarn incorporated in certain courses throughout the leg and foot portions, and more particularly to such a sock in which the courses including the elastomeric yarn are closer together in the foot portion than in the leg portion to provide greater compressive support in the foot portion than in the leg portion.

BACKGROUND OF THE INVENTION

It is known to incorporate elastomeric yarn in various portions of various types of hosiery articles. In some types of socks, the elastomeric yarn is incorporated in certain courses in the cuff and/or throughout the leg portion for the purpose of aiding in supporting the upper portion of the sock on the leg of the wearer. The elastomeric yarn provides sufficient inward compressive force against the leg of the wearer so that the sock will grip the leg with enough force to support the upper portion of the sock on the leg. However, this inward compressive force on the leg of the wearer may be sufficient to restrict the blood flow from the foot and up the leg of the wearer.

In some known types of socks the elastomeric yarn is incorporated in a band of compressive force in the medial portion of the foot to provide an arch support in an area around the medial portion of the foot of the wearer. This band of compressive force around the medial portion of the foot of the wearer also tends to limit the blood flow from the toes and up the leg of the wearer.

SUMMARY OF THE INVENTION

With the foregoing in mind, it is an object of the present invention to provide a sock with elastomeric yarn incorporated in certain courses throughout the leg and foot portions, and with such certain courses being closer together in the foot portion than in the leg portion to aid in the stimulation of blood flow from the foot up the leg of the wearer.

In a preferred embodiment of the present invention, the elastomeric yarn is incorporated in every other course throughout the leg portion and is incorporated in every course throughout the foot portion. The density of elastomeric yarn is thus greater in the foot portion than the density of the elastomeric yarn in the leg portion. The greater density of elastomeric yarn in the foot portion provides a snug fit and greater compressive support in the foot portion than in the leg portion.

The sock is preferably provided with reciprocatory heel and toe pockets and the elastomeric yarn is incorporated in every partial course of the heel and toe pockets. The elastomeric yarn is preferably incorporated in the certain courses of the leg and foot portions by being knit in plated relationship with the body yarn to provide two-way stretch throughout both the leg and foot portions.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
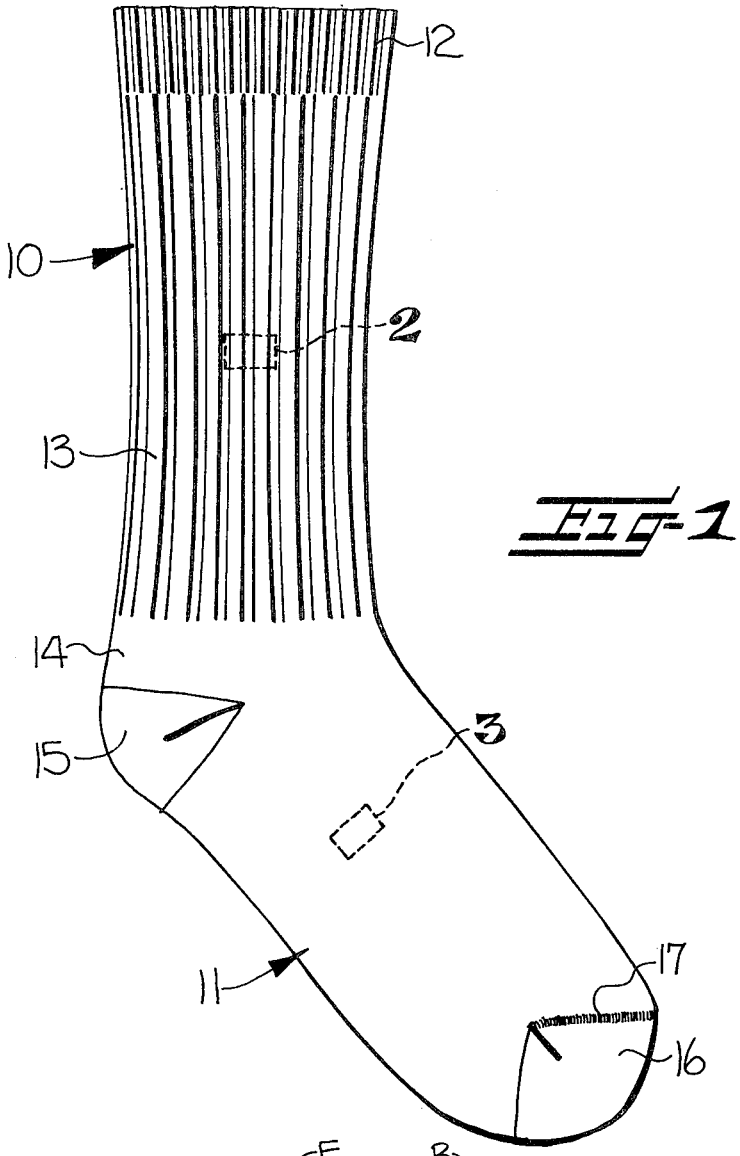
FIG. 1 is a side elevational view of the sock of the present invention and in flattened condition.

The hosiery article of the present invention is illustrated in FIG. 1 in the form of a sock including an integrally knit leg portion, broadly indicated at 10, and a foot portion, broadly indicated at 11. The leg and foot portions 10, 11 are knit throughout of successive courses of body yarn, indicated at B in FIGS. 2 and 3. The leg 10 includes an upper cuff 12 knit with a one-by-one rib stitch construction, a medial leg portion 13 knit with a two-by-two rib stitch construction, and lower ring courses 14 knit with a plain jersey stitch construction.

The foot 11 includes a reciprocatory heel pocket 15 which is of the usual type construction and is formed of gradually narrowed and widened partial courses. The foot 11 also includes a reciprocatory toe pocket 16 which is formed in the usual manner of gradually narrowed and widened partial courses. The toe pocket 16 is closed by a looper or seam line 17.

Figure 2:
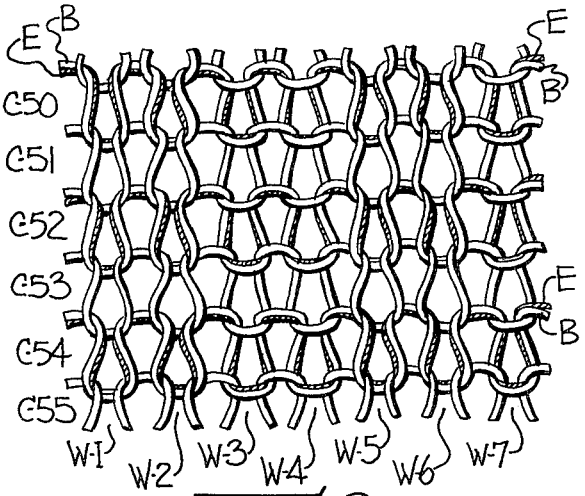
FIG. 2 is a greatly enlarged fragmentary elevational view taken substantially in the rectangle 2 in FIG. 1 and illustrating the manner in which the body yarn and elastomeric yarns are interknit in the leg portion.
Figure 3:
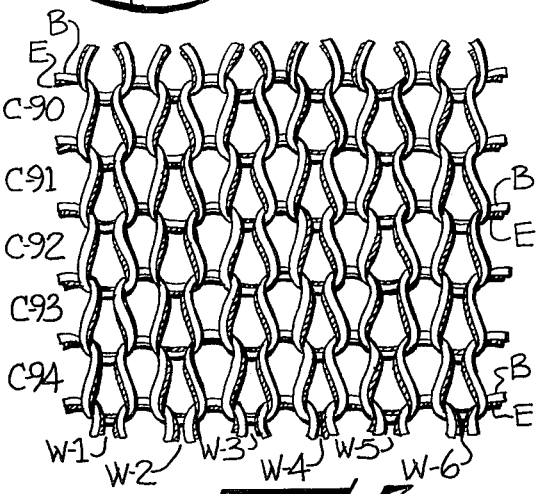
FIG. 3 is a view similar to FIG. 2 but being taken in the rectangular area 3 of FIG. 1 and illustrating the manner in which the elastomeric and body yarns are interknit in the foot portion.

In accordance with the present invention, an elastomeric yarn E is incorporated with the body yarn B in regularly repeated certain courses throughout the leg portion 10 (FIG. 2) and the elastomeric yarn E is also incorporated with the body yarn B in regularly repeated certain courses throughout the foot portion 11 (FIG. 3). The regularly repeated certain courses in which the elastomeric yarn E is incorporated in the foot portion 11 are closer together than the regularly repeated certain courses with the elastomeric yarn in the leg portion 10 so that the density of the elastomeric yarn is greater in the foot portion 11 than the density of the elastomeric yarn in the leg portion 10. The greater density of the elastomeric yarn in the foot portion 11 provides a snug fit in the foot portion, provides greater compressive support in the foot portion 11 than in the leg portion 10 and also aids in the stimulation of blood flow from the foot and up the leg of the wearer.

A preferred embodiment of the sock is illustrated in FIGS. 2 and 3 in which the elastomeric yarn E is incorporated with the body yarn B in every other course, courses C-50, C-52 and C-54, in the leg portion 10 (FIG. 2) while the elastomeric yarn E is incorporated with the body yarn B in every course, courses C-90 through C-94, of the foot portion 11 (FIG. 3). The elastomeric yarn E is also incorporated with the body yarn B in every narrowed and widened partial course of both the heel pocket 15 and the toe pocket 16. In FIGS. 2 and 3, the elastomeric yarn E is illustrated as being incorporated with the body yarn B by being knit in plated relationship with the body yarn B to provide two-way stretch in both the leg portion 10 and the foot portion 11. The body yarn B may be any of the types of yarns usually used in knitting socks and the elastomeric yarn E may be a synthetic stretchable yarn, such as spandex, or it may be a natural elastic yarn, such as rubber, either bare or covered.

It has been found that a very attractive and comfortable sock may be knit, in accordance with the present invention, on a 72 needle two-feed Komet hosiery knitting machine. A worsted wool body yarn B is knit in plated relationship with an elastomeric yarn E of 140 denier bare or uncovered Lycra at one knitting station and the worsted wool body yarn B is knit alone at the other knitting station throughout the leg 10. The cuff 12 is knit with a one-by-one rib and the medial portion of the leg 13 is knit with a two-by-two rib construction. As illustrated in FIG. 2, the wales W-1, W-2, and W-5, W-6 are knit on one group of needles and the stitch loops face outwardly of the sock while the wales W-3, W-4 and W-7 are knit on the other group of needles and the stitch loops face inwardly of the sock. The lower ring courses 14 of the leg 10 and the entire foot 11 are knit of plain jersey fabric, and the elastomeric yarn E is knit in plated relationship with the body yarn B in every course, as illustrated in FIG. 3. The foot 11 may be knit by using only the feed of the knitting machine which is knitting both the body yarn B and the elastomeric yarn E, or by using both feeds and knitting both the body yarn B and the elastomeric yarn E at both knitting stations so that the elastomeric yarn E is plated with the body yarn B in every course.

If desired, the elastomeric yarn E may be plied with the body yarn B or otherwise incorporated therein, prior to knitting. It is preferred that the elastomeric yarn E in the leg 10 and the elastomeric yarn E in the foot 11 are of the same type and size.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a hosiery article including integral leg and foot portions knit throughout of successive courses of body yarn, the combination therewith of elastomeric yarn incorporated in regularly repeated courses throughout said leg portion, and elastomeric yarn incorporated in regularly repeated courses throughout said foot portion, the density of the elastomeric yarn being greater in said foot portion than the density of the elastomeric yarn in said leg portion, the greater density of the elastomeric yarn in said foot portion providing a snug fit in said foot portion, greater compressive support in said foot portion, and aiding in the stimulation of blood flow from the foot and up the leg of the wearer.

2. A hosiery article according to claim 1 wherein said hosiery article comprises a sock, wherein said elastomeric yarn is incorporated in every other course of said leg portion, and wherein said elastomeric yarn is incorporated in every course of said foot portion.

3. A hosiery article according to claim 2 including a reciprocatory heel and toe pocket formed of narrowed and widened partial courses, and wherein said elastomeric yarn is incorporated in every partial course of said heel and toe pocket.

4. A hosiery article according to claim 3 wherein the major portion of said leg portion comprises rib fabric, and wherein said foot portion comprises plain jersey knit fabric.

5. A hosiery article according to claims 1, 2, 3, or 4 wherein said elastomeric yarn is incorporated in said courses of said leg and foot portions by being knit in plated relationship with said body yarn to provide two-way stretch in both said leg and foot portions.

6. In a hosiery article including integral leg and foot portions knit throughout of successive courses of body yarn, the combination therewith of elastomeric yarn of a certain size incorporated in every other course throughout said leg portion, and the same size elastomeric yarn incorporated in every course throughout said foot portion so that a greater density of the elastomeric yarn is provided in said foot portion than the density of the elastomeric yarn in said leg portion, the greater density of the elastomeric yarn in said foot portion providing a snug fit in said foot portion, greater compressive support in said foot portion than in said leg portion, and aiding in the stimulation of blood flow from the foot and up the leg of the wearer.

* * * * *